US005096609A

United States Patent [19]

Dany et al.

[11] Patent Number: 5,096,609

[45] Date of Patent: Mar. 17, 1992

[54] DETERGENT CONTAINING SODIUM DISILICATE HAVING A WATER CONTENT OF 0.3 TO 6% BY WEIGHT

[75] Inventors: Franz-Josef Dany, Erftstadt; Werner Gohla, Niederkassel; Gerhard Kalteyer; Joachim Kandler, both of Erftstadt; Hans Krämer, Köln, all of Fed. Rep. of Germany

[73] Assignee: Hoechst Aktiengesellschaft, Frankfurt am Main, Fed. Rep. of Germany

[21] Appl. No.: 649,451

[22] Filed: Feb. 1, 1991

[30] Foreign Application Priority Data

Feb. 15, 1990 [DE] Fed. Rep. of Germany ..... 4004626

[51] Int. Cl.[5] ..... C11D 3/08; C11D 7/14; C11D 9/10

[52] U.S. Cl. ..... 252/135; 252/109; 252/DIG. 11; 423/326

[58] Field of Search ..... 252/135, 109, DIG. 11; 423/326

[56] References Cited

U.S. PATENT DOCUMENTS

| | | | |
|---|---|---|---|
| 3,562,165 | 2/1971 | Alfieri | 252/135 |
| 3,816,320 | 6/1974 | Corliss | 252/99 |
| 3,847,663 | 11/1974 | Shumaker | 134/2 |
| 4,077,897 | 7/1978 | Gault | 252/99 |
| 4,199,468 | 4/1980 | Barford et al. | 252/103 |
| 4,390,441 | 6/1983 | Beavan | 252/135 |
| 4,806,260 | 2/1989 | Broze | 252/135 |

FOREIGN PATENT DOCUMENTS

| | | |
|---|---|---|
| 0256679 | 6/1988 | European Pat. Off. . |
| 2345511 | 1/1977 | France . |
| 2006257 | 2/1979 | United Kingdom . |

*Primary Examiner*—A. Lionel Clingman
*Assistant Examiner*—Erin M. Higgins
*Attorney, Agent, or Firm*—Connolly & Hutz

[57] ABSTRACT

A detergent containing 5 to 50% by weight of at least one surfactant, 0.5 to 60% by weight of a matrix substance and also standard laundry aids, contains as matrix substance an amorphous, low-water sodium disilicate having a water content of 0.3 to 6% by weight which has preferably been produced by partial dehydration of commercially available powdered amorphous sodium disilicate having a water content of 15 to 23% by weight.

4 Claims, No Drawings

DETERGENT CONTAINING SODIUM DISILICATE HAVING A WATER CONTENT OF 0.3 TO 6% BY WEIGHT

The invention relates to a detergent containing 5 to 50% by weight, preferably 10 to 30% by weight, of at least one surfactant, 0.5 to 60% by weight of a matrix substance and also standard laundry aids.

It has been the prior art for more than 80 years to incorporate sodium silicates, generally in the form of their aqueous solution and also described as waterglass, in detergent formulations.

Sodium silicates were used for a long time, especially in conjunction with soda, as matrix substances in detergents, but in the course of modern detergent development they were replaced by substances with better builder properties such as, for example, condensed phosphates.

Owing to the restrictive detergent phosphate legislation which has come into force in many European countries and the USA, zeolite 4A in conjunction with polycarboxylates is today the basic matrix substance for many detergent products. The addition of amorphous sodium disilicate in the form of waterglass or as a powder in an amount of around 5% by weight is also today still usual in the majority of finished detergents. The function of the sodium disilicate is not limited in this connection to its corrosion-inhibiting action. It also acts as matrix substance with good absorption properties for liquid constituents and, because of its dispersant action, improves the soil antiredeposition capability of the washing liquor. In addition, it binds some of the hardening constituents of the washing water and as a result also benefits the washing result.

As has now been found, surprisingly, the technical washing properties of commercially available sodium disilicates, which normally have a water content of 15–23% by weight, can be substantially increased if these products are partially dehydrated.

In order to partially dehydrate such sodium disilicates to form amorphous sodium disilicates having a water content of 0.3 to 6% by weight, preferably of 0.5 to 2% by weight, for example, the powdered amorphous sodium disilicate having a water content of 15 to 23% by weight is introduced into a rotary tubular kiln which is arranged at an angle and fitted with devices for agitating solid and in which it is treated in countercurrent with furnace gas at temperatures of 250° to 500° C. for 1 to 60 minutes, the rotary tubular kiln being insulated in a manner such that the temperature of its outside wall is less than 60° C. The amorphous sodium disilicate emerging from the rotary tubular kiln can be comminuted to particle sizes of 0.1 to 12 mm with the aid of a mechanical crusher. Preferably, the comminuted sodium disilicate is ground to a particle size of 2 to 400 μm in a mill, the mill being operated with a circumferential velocity of 0.5 to 60 m/s.

In detail, the detergent of the present invention now comprises an amorphous low-water sodium silicate having a water content of 0.3 to 6% by weight as matrix substance.

In addition, the detergent of the invention is optionally and preferably one wherein a) the amorphous sodium disilicate contains 0.5 to 2% by weight of water;

b) the amorphous low-water sodium disilicate it contains as matrix substance has been produced by partial dehydration of commercially available powdered amorphous sodium disilicate having a water content of 15 to 23% by weight c) the amorphous low-water sodium disilicate it contains as matrix substance has been produced by introducing powdered amorphous sodium disilicate having a water content of 15 to 23% by weight into a rotary tubular kiln arranged at an angle and fitted with devices for agitating solid and in which it has been treated in countercurrent with furnace gas at temperatures of 250° to 500° C. for 1 to 60 minutes, the tubular rotary kiln having been insulated in a manner such that the temperature of its outside wall was less than 60° C., and by comminuting the amorphous sodium disilicate emerging from the rotary tubular kiln to a particle size of 0.1 to 12 mm with the aid of a mechanical crusher and then grinding to a particle size of 2 to 400 μm with a mill.

Starting from a commercially available sodium disilicate having a water content of 18% by weight, the following partially dehydrated products were produced:

| Example | Water content (% by weight of $H_2O$) |
|---|---|
| I (starting material) | 18 |
| II | 0.3 |
| III | 0.7 |
| IV | 1.5 |
| V | 3.1 |
| VI | 5 |

Detergents were manufactured by the spray mist mixing process in accordance with the following basic formulation containing the individual sodium disilicate species (NaDS; Examples I–VI)

| Constituents | Detergent formulations % by weight A | | B | |
|---|---|---|---|---|
| NaDS.aq (Example I–VI) | | 25 *) | | 45 *) |
| Na perborate tetrahydrate | | 10.0 | | 10.0 |
| Na percarbonate | | 8.0 | | 8.0 |
| Anionic surfactants | | 12.0 | | 12.0 |
| alkyl benzenesulfonate | 7.5 | | 7.5 | |
| soap | 4.5 | | 4.5 | |
| Nonionic surfactants (fatty alcohol ethoxylates) | | 5.0 | | 5.0 |
| Polycarboxylate (acrylic acid/maleic acid, MW approx. 60,0000) | | 4.0 | | 4.0 |
| Cellulose ether | | 2.0 | | 2.0 |
| Enzymes | | 0.5 | | 0.5 |
| Optical brighteners | | 0.2 | | 0.2 |
| Na sulfate, water and minor constituents | | to 100 | | to 100 |

*) in all cases calculated for $Na_2Si_2O_5$

In all cases 2.5 g or 4.5 g of the Na disilicates in accordance with Examples I–VI were dissolved in 1000 ml of water of 18° German hardness for the purpose of determining their water hardness bonding capacity (remaining residual water hardness), the solution was stirred for exactly ½ hour at 60° C. by means of a magnetic stirrer at approximately 500 rev/min, then cooled rapidly to 20° C. in ice water and subsequently freed from insoluble residue by means of a membrane filter having a pore size of 0.45 μm. The same procedure was also carried out with the water used of 18° German hardness not containing added Na disilicate in order to eliminate the error which could arise through a possible precipitation of Ca and Mg as carbonate.

In the same way 10 g of the detergents based on the above basic formulation containing Na disilicate in accordance with Examples I–VI were dissolved in each case in water of 18° German hardness and the solutions were treated as described above. The basic formulation not containing added Na disilicate was used as a blank sample in the experimental series.

The residual contents of calcium and magnesium, which are listed in Table 1, in the filtrates of the individual solutions and also in the identically treated and filtered water without additive were determined by means of atomic absorption:

TABLE 1

| Example | Residual water hardness (mg of alkaline earth metal/1000 ml of $H_2O$) | | | | | | | |
|---|---|---|---|---|---|---|---|---|
| | $Na_2Si_2O_5$.aq (2,5 g/1000 ml $H_2O$) | | Detergent A (10 g/1000 ml $H_2O$) | | $Na_2Si_2O_5$.aq (4,5 g/1000 ml $H_2O$) | | Detergent B (10 g/1000 ml $H_2O$) | |
| | Ca | Mg | Ca | Mg | Ca | Mg | Ca | Mg |
| I $Na_2Si_2O_5$ 18% $H_2O$ | 18 | 5 | 22 | 5 | 17 | 5 | 20 | 4 |
| II $Na_2Si_2O_5$ 0.3% $H_2O$ | 6 | 2 | 17 | 2 | 5 | 1 | 14 | 1 |
| III $Na_2Si_2O_5$ 0.7% $H_2O$ | 2.5 | <1 | 12 | 1 | 3 | 1 | 7.5 | 1 |
| IV $Na_2Si_2O_5$ 1.5% $H_2O$ | 3 | 1 | 12 | 1 | 3 | 1 | 9 | 1 |
| V $Na_2Si_2O_5$ 3.1% $H_2O$ | 3.5 | 1 | 17 | 2 | 4 | 1 | 15 | 1 |
| VI $Na_2Si_2O_5$ 5% $H_2O$ | 3.5 | 1.5 | 18 | 2 | 4 | 1 | 16 | 2 |
| Blank samples Water used | 85 | 15 | — | — | 85 | 15 | — | — |
| Basic formulation (without $Na_2Si_2O_5$ added) | — | — | 75 | 18 | — | — | 72 | 19 |

From the values found for the residual water hardness, the superiority of the partially dehydrated Na disilicates (Examples II–VI) over the starting products containing 18% by weight of $H_2O$ (Example I) emerges clearly.

Since a higher capacity to bond the water hardness in general also makes it possible to expect an improvement in the washing result, washing experiments were carried out in a domestic washing machine under the following conditions using the detergents (type A) which had been finished with the individual Na disilicate species in accordance with Examples I–IV:

| | |
|---|---|
| Washing machine: | Miele TMT |
| Temperature: | 60° C. |
| Water hardness: | 18° German hardness |
| Ballast: | 3.75 kg of unsoiled test fabric |
| Program: | one-wash cycle |
| Detergent dosage: | 175 g |

Test fabric used:
(EMPA=Swiss Material Testing Institute, St. Gallen, Switzerland;
WFK=Laundry Research, Krefeld)

| | |
|---|---|
| a) For primary washing effect (soil removal and bleaching): | |
| EMPA BW 101 | (standard soiling) |
| EMPA PE/BW 104 | (standard soiling) |
| WFK BW 10C | (standard soiling) |
| WFK BW 10G | (tea soiling) |
| WFK PE/BW 20G | (tea soiling) |
| b) for secondary washing effect: | |
| EMPA - cotton | |
| WFK - terry cloth | |

The primary washing effect was tested by means of optical remission measurement and expressed in the form of the remission difference which is obtained from the difference in the values after and before washing:

$\Delta R = R_a - R_b$ $\Delta R$ = remission difference (%)

$R_a$ = remission after washing (%)

$R_b$ = remission before washing (%).

The ash value as a measure of the fabric incrustation was determined after 25 laundering cycles by determining the ignition residue in percent at 800° C.

Table 2 summarizes the washing results which were obtained with the detergents (type A) based on Na disilicates in accordance with Examples I–VI. As expected, the detergents (type A) finished with partially dehydrated Na disilicate exhibit a marked superiority over the detergent formulation based on the starting product (Example I, Na disilicate containing 18% $H_2O$).

The detergents (type A) produced on the basis of Examples I–VI were subjected to a test to determine shelf life. In this, the individual detergent samples were stored in sealed pasteboard boxes (wax box, water vapor permeability: approximately 10 $g \cdot m^{-2} \cdot day^{-1}$ in a climatic test chamber at 37° C. and 70% relative atmospheric humidity for 4 weeks. The flowability was determined in accordance with Table 3. As can be gathered from. Table 3, the detergents (type A) based on the partially dehydrated products according to the invention (Examples II–VI) appear clearly superior in that they more or less retain their flowability while the commercially available Na disilicate (Example I) hardens completely under the chosen storage conditions.

TABLE 2

Washing experiments
(one-wash cycle, 60° C./18° German hardness)
Primary washing effect (soil removal/bleaching)

| | Formulation (type A) | Remission difference | | | | |
|---|---|---|---|---|---|---|
| | | EMPA | | WFK | WFK | |
| | | BW 101 | PE/BW 104 | BW 10C | BW 10G | PE/BW 20G |
| I | Commercially available NaDS containing 18% $H_2O$ | 16 | 21 | 20 | 16 | 27 |
| II | (NaDS 0.3% $H_2O$) | 19 | 23 | 24 | 21 | 31 |
| III | (NaDS 0.7% $H_2O$) | 21 | 25 | 25 | 23 | 34 |
| IV | (NaDS 1.5% $H_2O$) | 22 | 27 | 25 | 24 | 35 |
| V | (NaDS 3.1% $H_2O$) | 22 | 26 | 24 | 22 | 33 |
| VI | (NaDS 5.0% $H_2O$) | 21 | 24 | 23 | 22 | 30 |

TABLE 2-continued

| Washing experiments (one-wash cycle, 60° C./18° German hardness) Primary washing effect (soil removal/bleaching) | | Secondary washing effect (fabric ash) (One-wash cycle, 60° C./18° German hardness - 25 wash cycles) % ash | |
|---|---|---|---|
| | | EMPA cotton | WFK terry cloth |
| I | Commercially available NaDS containing 18% $H_2O$ | 5.5 | 7.1 |
| II | (NaDS 0.3% $H_2O$) | 3.8 | 4.6 |
| III | (NaDS 0.7% $H_2O$) | 3.1 | 4.5 |
| IV | (NaDS 1.5% $H_2O$) | 2.4 | 4.2 |
| V | (NaDS 3.1% $H_2O$) | 2.8 | 4.7 |
| VI | (NaDS 5.0% $H_2O$) | 3.0 | 4.7 |

TABLE 3

| Shelf life of the detergent formulations I-VI (type A) (Conditions: 37° C./70% relative atmospheric humidity/4 weeks) | | |
|---|---|---|
| | Formulation | |
| I | commercially available NaDS containing 18% $H_2O$ | nonflowable (complete hardening) |
| II | (NaDS 0.3% $H_2O$) | flowable |
| III | (NaDS 0.7% $H_2O$) | flowable |
| IV | (NaDS 1.5% $H_2O$) | flowable |
| V | (NaDS 3.1% $H_2O$) | still flowable, slight lump formation |
| VI | (NaDS 5.0% $H_2O$) | partly flowable, severe lump formation |

Anionic surfactants are understood to mean the water-soluble salts of higher fatty acids or resin acids such as sodium soaps or potassium soaps of coconut, palm kernel or rape oil and also of tallow and mixtures thereof. They furthermore include higher alkylsubstituted aromatic sulfonates such as alkylbenzenesulfonates containing 9 to 14 carbon atoms in the alkyl radical, alkylnaphthalenesulfonates, alkyltoluenesulfonates, alkylxylenesulfonates or alkylphenolsulfonates; fatty alcohol sulfates ($R—CH_2—O—SO_3Na$; $R=C_{11-17}$) or fatty alcohol ether sulfates such as alkali-metal lauryl sulfate or alkali-metal hexadecyl sulfate, triethanolamine lauryl sulfate, sodium oleyl sulfate or potassium oleyl sulfate, sodium salts or potassium salts of lauryl sulfate ethoxylated with 2 to 6 mol of ethylene oxide Further suitable anionic surfactants are secondary linear alkanesulfonates such as $\alpha$-olefinsulfonates having a chain length of 12–20 carbon atoms.

Nonionic surfactants are understood to mean those compounds which contain an organic hydrophobic group and also a hydrophilic radical, for example the condensation products of alkylphenols or higher fatty alcohols with ethylene oxide (fatty alcohol ethoxylates), the condensation products of polypropylene glycol with ethylene oxide or propylene oxide, the condensation products of ethylene oxide with the reaction product of ethylenediamine and propylene oxide and also long-chain tertiary amine oxides

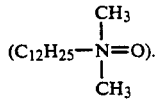

Finally surfactants having zwitterionic (ampholytic) character comprise the following compounds:

Derivatives of aliphatic secondary and tertiary amines or quaternary ammonium compounds containing 8 to 18 carbon atoms and a hydrophilic group in the aliphatic radical such as, for example, sodium 3-dodecylaminopropionate, sodium 3-dodecylaminopropanesulfonate, 3-(N,N-dimethyl-N-hexadecylamino)-propane-1-sulfonate or fatty acid aminoalkyl-N,N-dimethylacetobetaine, the fatty acid containing 8 to 18 carbon atoms and the alkyl radical 1–3 carbon atoms.

Suitable laundry aids according to the invention are inorganic or organic salts, in particular inorganic or organic complexing agents, having a weakly acid, neutral or alkaline reaction.

Usable salts with a weakly acid, neutral or alkaline reaction are, for example, the bicarbonates or carbonates of the alkali metals, furthermore the alkali-metal salts of organic non-capillary-active sulfonic acids containing 1 to 8 carbon atoms, carboxylic acids and sulfocarboxylic acids. These include, for example, water-soluble salts of benzene-, toluene- or xylenesulfonic acid, water-soluble salts of sulfoacetic acid, sulfobenzoic acid or salts of sulfodicarboxylic acids and also the salts of acetic acid, lactic acid, citric acid, tartaric acid, oxydiacetic acid ($HOOC—CH_2—O—CH_2—COOH$), oxydisuccinic acid, 1,2,3,4-cyclopentanetetracarboxylic acid, polycarboxylates, polyacrylic acid and polymaleic acid. The organic complexing agents include, for example, nitrilotriacetic acid, ethylenediaminetetraacetic acid, N-hydroxyethylethylenediaminetriacetic acid or polyalkylene-polyamine-N-polycarboxylic acids.

Laundry aids according to the invention furthermore comprise products such as the alkali-metal salts or ammonium salts of sulfuric acid, boric acid, alkylene-, hydroxyalkylene- or aminoalkylenephosphonic acid and also bleaching agents, stabilizers for peroxide compounds (bleaching agents) and water-soluble organic complexing agents.

In detail, the bleaching agents include sodium perborate mono- or tetrahydrate, Na percarbonate, the alkali-metal salts of peroxomono- or peroxodisulfuric acid, the alkali-metal salts of peroxodiphosphoric acid ($H_4P_2O_8$), and alkali-metal salts of peroxycarboxylic acids such as diperoxydodecanedioic acid. Water-soluble precipitated magnesium silicate, organic complexing agents such as the alkali-metal salts of iminodiacetic acid, nitrilotriacetic acid, ethylenediaminetetraacetic acid, methylenediphosphonic acid, 1-hydroxyethane-1,1-diphosphonic acid and nitrilotrismethylenephosphonic acid act as stabilizers for these bleaches.

Laundry aids which increase the soil antiredeposition capability of wash liquors, such as carboxymethylcellulose, carboxymethyl starch, methylcellulose or copolymers of maleic anhydride with methyl vinyl ether or acrylic acid, foam regulators such as mono- and dialkyl phosphoric acid esters containing 16 to 20 carbon atoms in the alkyl radical and also optical brighteners, disinfectants and enzymes such as proteases, amylases and lipases, can also be additional constituents of the detergent of the invention.

We claim:

1. A flowable, granular detergent which comprises 5 to 50% by weight of at least one anionic, nonionic or zwitterionic surfactant, 0.5 to 60% by weight of amorphous low-water sodium disilicate having a water content of 0.3 to 6% by weight as matrix substance and also standard laundry aids.

2. The detergent as claimed in claim 1, wherein the amorphous sodium disilicate contains 0.5 to 2% by weight of water.

3. The detergent as claimed in claim 1, wherein the amorphous low-water sodium disilicate has been produced by partial dehydration of commercial powdered amorphous sodium disilicate having a water content of 15 to 23% by weight.

4. The detergent as claimed in claim 3, wherein the amorphous low-water sodium disilicate has been obtained by introducing powdered amorphous sodium disilicate having a water content of 15 to 23% by weight into a rotary tubular kiln arranged at an angle and fitted with devices for agitating solid and in which it has been treated in countercurrent with furnace gas at temperatures from 250° to 500° C. for 1 to 60 minutes, the rotary tubular kiln having been insulated in a manner such that the temperature of its outside wall was less than 60° C., and by comminuting the amorphous sodium disilicate emerging from the rotary tubular kiln to a particle size of 0.1 to 12 mm with a mechanical crusher and then grinding to a particle size of 2 to 400 μm with a mill.

* * * * *